United States Patent [19]

Olsen

[11] 4,301,918

[45] Nov. 24, 1981

[54] CONTAINER CARRIER PREFORM

[75] Inventor: Robert C. Olsen, Streamwood, Ill.

[73] Assignee: Illinois Tool Works Inc., Chicago, Ill.

[21] Appl. No.: 151,029

[22] Filed: May 19, 1980

[51] Int. Cl.[3] ..... B65D 71/02

[52] U.S. Cl. ..... 206/150; 206/151

[58] Field of Search ..... 206/150, 151

[56] References Cited

U.S. PATENT DOCUMENTS

| | | | |
|---|---|---|---|
| 3,044,230 | 7/1962 | Fisher | 206/150 |
| 3,627,123 | 12/1971 | Nachter | 206/150 |
| 3,733,100 | 5/1973 | Tanzer | 206/150 |
| 3,785,484 | 1/1974 | Cunningham | 206/150 |
| 3,938,656 | 2/1976 | Owen | 206/150 |
| 3,946,862 | 3/1976 | Klygis et al. | 206/150 |
| 3,966,044 | 6/1976 | Cunningham | 206/150 |
| 4,109,787 | 8/1978 | Klygis et al. | 206/150 |
| 4,121,712 | 10/1978 | Cunningham | 206/150 |
| 4,136,771 | 1/1979 | Owen | 206/150 |
| 4,219,117 | 8/1980 | Weaver et al. | 206/150 |

*Primary Examiner*—Joseph Man-Fu Moy

*Attorney, Agent, or Firm*—Thomas W. Buckman

[57] ABSTRACT

A strip of thermo-plastic material particularly designed to be longitudinally, permanently stretched, so as to be transformed into a container multi-packaging device having a plurality of can receiving apertures which are configured to include an outer band portion and an inner band portion from a strip with limited amount of material removed in series of narrow transversely arranged slot means. The slot means are particularly designed to produce inner band portions which are generally V-shaped and slightly stretched and outer band portions which are generally parallel to the axis of the strip and highly stretched to longitudinal orientation.

8 Claims, 6 Drawing Figures

CONTAINER CARRIER PREFORM

BACKGROUND AND SUMMARY OF THE INVENTION

This invention relates to thermo-plastic, multiple container carrier and handling devices. The invention more particularly relates to a strip of plastic material which may be transformed into such a plastic multi-packaging device capable of effective association with the plurality of can-type carriers.

Container carrier devices of the type described are widely used and a variety of forms have been considered, including the devices shown in U.S. Pat. No. 2,874,835 and more recently devices which utilize significantly less material by creating a series of integral, resilient thin bands that are dependent upon one another to be reconfigured from a first non-circular configuration to a second, generally circular configuration. The last mentioned type of devices are shown in more recently issued U.S. Pat. No. 4,018,331 and currently co-pending application, Ser. No. 31,231.

Other efforts have also been made to reduce the amount of plastic material utilized in such carrier devices by designing "scrapless" type carrier configurations, for example, as shown in U.S. Pat. Nos. 3,084,792 and 3,044,230. This type of carrier generally may be described as a plurality of series of slits longitudinally of the strip designed so that the carrier can be transversely stretched during application to can-type containers.

Further examples of attempts to reduce material and retain strength are shown in U.S. Pat. No. 3,232,422 which involves a strip of material which includes a series of relatively small apertures which would be stretched during application to a final configuration approximating the perimeter of the can to which it is associated.

It should be noted that new applicating techniques involve specific carrier designs that require application of transverse stretching forces to a continuously moving strip of carrier devices transforming bands from an initial aperture configuration to a final aperture configuration. It should further be noted that efforts to reduce material content in carrier devices must be accomplished with constraints such as retention of resiliency in the device during use as a multi-packaging device, strength to resist "necking" or tearing during application to cans, regrinding of material punched from carrier strip, appearance and handling of resulting package, etc.

Against the foregoing background, the subject invention represents a unique advance in the art, because of the unique design and use of a preform carrier strip which is transformed to a strip of carrier devices prior to application.

It is accordingly a primary object of the invention to provide a preform device which can be transformed permanently into a package making strip which in turn can be transformed from a non-circular hole to a hole which can be efficiently associated with a plurality of generally cylindrical cans.

A further principle object of the invention is to provide a carrier preform and carrier which attempts to minimize the material used while maximizing the strength of the carrier device and integrity of the package created thereby.

An advantage of the invention is the reduction in the amount of material punched from a strip of package making material, thus reducing the amount of material to be reground and circulated into the raw material.

A further advantage of the invention is the use of the particular preform to produce a highly oriented and strengthened carrier device of the type generally described above, which may permit the use of thinner strips of package making material.

The above objects and advantages are obtained by the preform of the invention which basically includes a strip of plastic material which is provided with a plurality of series' of very narrow slots extending generally perpendicular to the longitudinal axis of the strip. The slots are particularly arranged so that upon predetermined stretching forces applied longitudinally of the strip, the strip itself is transformed into a carrier device strip which includes a plurality of container engaging bands each of which includes an inner section of generally V-shaped configuration and an outer, generally straight, band. Thus, the eventual carrier device created is a "dynamic" device in that it is to be transformed into a container encircling shape as a result of the application of transverse stretching forces.

More particularly, the preform strip includes a first series of slots which are a pair of laterally opposing narrow width slots extending on either side of the center line of the strip. A second series of narrow slots is positioned to be intermediate adjacent first series of slots and each of the second series slots extending through the longitudinal center line of the strip. The base of the first series of slots is adapted to be highly stretched and oriented in the outer band regions while the strip segments between adjacent first and second series of slots form the segments of the V-shaped inner sections of the carrier device.

Other objects and features of the invention will be readily apparent upon perusal of the hereinafter following specification and drawings.

DETAILED DESCRIPTION OF THE PREFERRED EMBODIMENT

Figure 1:
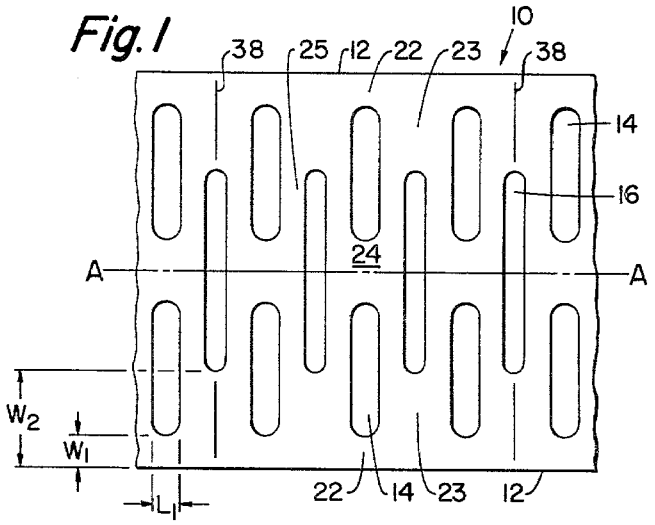
FIG. 1 is a top plan view of a segment of a preferred embodiment of a preform strip incorporating the invention.

In all three of the various embodiments described herein, the invention will be described as a preform strip and a carrier device strip subsequently formed from the preform strip. The resulting carrier device strip will be referred to by its individual elements with like reference numerals on the carrier device describing corresponding elements in the preform device except that the reference numerals on the carrier device will include a prefix "1" before the corresponding reference numeral used to identify associated portions of the preform. Likewise, the various embodiments of both the preform and the resultant carrier device are identified by like reference numerals throughout the various views with the addition of suffixes "a" or "b" to designate the different embodiments.

Figure 2:
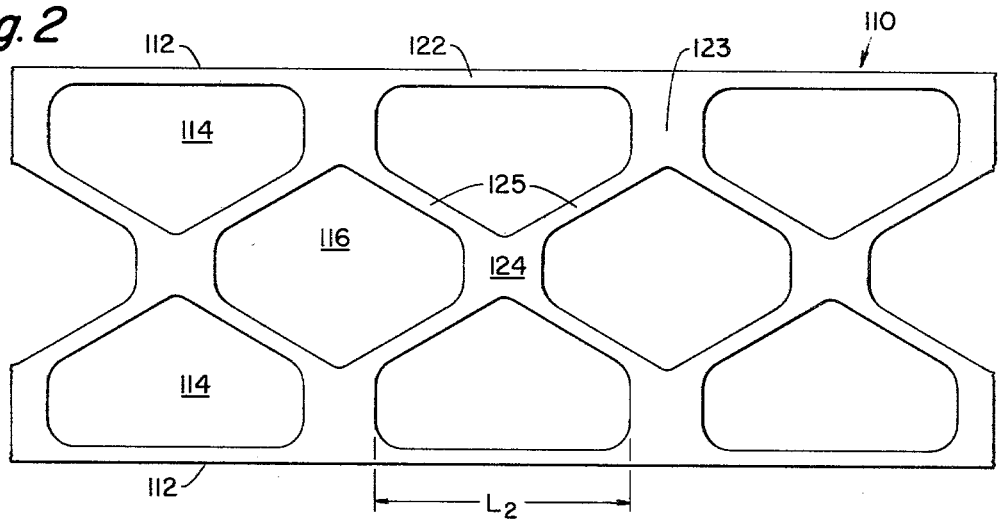
FIG. 2 is a top plan view of a segment of the carrier device created by the preform of FIG. 1.

Referring first to FIG. 1, a representative embodiment of a preform in accordance with the invention is shown. Likewise, the carrier device which results from a proper stretching manipulation of such a preform is shown in FIG. 2. Container carrier preform strip 10 is preferably created from a thin sheet of film plastic material, for example polyethylene, which is capable of being stretched to high molecular orientation. The strip is of a predetermined design which is delineated by side marginal edges 12 and it is punched with a plurality of series of very narrow slot-like apertures. The narrow slots extend transversely of the strip and generally perpendicular to the longitudinal center line A—A of the strip.

A first series of such slots include a pair of slots 14 which extend on either side of the center line A—A of the strip and are separated in the central region of the strip by a strip segment 24. In alternating fashion, a second series of slots 16 are positioned so as to extend through the center line of the strip.

It should be noted that the extremities of the first slots, on either side of the center line are spaced from the associated side marginal edge 12 a first distance W1. This distance is created by a segment 22 which is of the predetermined width determined by W1 and a predetermined length dimension L1 which is determined by the width of the slot 14 in the region adjacent the marginal edges 12.

A strip segment 25 should be noted as extending between the adjacent edges of the first slot 16 and 14. In the embodiment shown, illustrative of the invention, the width of each of the slots 14 and 16 is substantially constant throughout the length which is mentioned above and extends perpendicularly to the axis of the strip.

Turning now to FIG. 2, the carrier device which is created by the use of the preform 10 is shown. Carrier device 110 is in fact produced by highly stretching preform 10 in the direction of the longitudinal axis A—A. The stretching is preferably accomplished by gripping or holding regions at strip segments 23 and 24 and pulling the strip so that region 23 and its original length L1 is greatly increased. Thus, a region of highly stretched material is created in the strip segment 22 resulting in a highly, permanently stretched and oriented band portion 122. The strip segments 25 of the preform 10 in turn are slightly longitudinally and laterally stretched to conform to the newly created length L2 of the band 122 and in turn form a V-shaped band section 125. Aperture 114 is the aperture which is then capable of being reformed by applying laterally directed forces to the outer band region 122. This reforming or carrier device applying operation forms no part of the instant invention and can be more clearly explained in the prior art U.S. Pat. No. 4,018,331 and U.S. Application, Ser. No. 31,231 as noted above. It should, however, be noted that regions 23 and 24 of the preform are substantially unstretched in the carrier device forming operation resulting in segments 123 and 124 in the carrier device that completely retain resilience. The region 22 is totally stretched and oriented to become strengthened bands 122.

The larger aperture 116 which is formed by the stretching process thus forms a finger hole aperture in the resultant carrier. The band segment 124 in conjunction with band segment 123 forms the lateral and longitudinal connection between laterally aligned and longitudinally aligned bands respectively in keeping with the practice of prior art carrier devices.

Thus, the particular arrangement of the narrow slots 14 and 16 and the particular relationship between the lateral distance of the segments 22 and 23 are important in creating an aperture configured as including a V-shaped inner band section and relatively straight, highly oriented and thus strengthened outer band section 122. Since the force of eventual application of the carrier device 110 is applied primarily by the use of jaw members acting at the outer band section 122, the high orientation and improved strength is an important feature of the invention as is the slightly stretched and yet resilient inner band sections 125 in creating a tight conforming package for can-type carriers.

The distance W1 is substantially less than the transverse dimension W2 defining the distance between the extremity of second slots 16 and the lateral edges 12. This relationship enables the stretching of the preform to create the V-shaped inner band sections 125.

It should be understood that the preform strip and resulting carrier strip are intended for continuous association with can-like containers with the carrier strip thereafter separated into the particular number of ranks desired by the package. To facilitate the separation of one package defining segment from another, weakened or frangible connections 38 may be provided. These connections are shown only in FIG. 1 but this feature can obviously be utilized in all embodiments of the invention.

Figure 3:
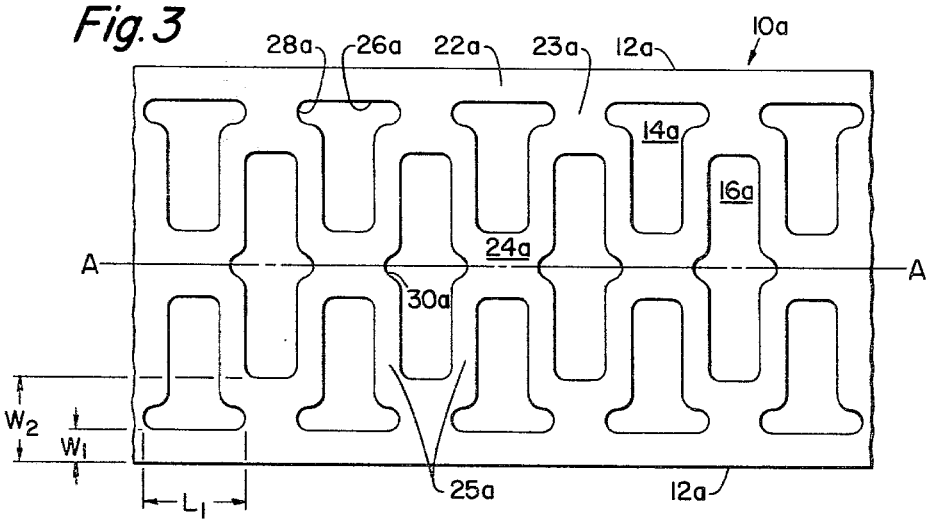
FIG. 3 is a top plan view of another embodiment of a preform strip incorporating the invention.
Figure 4:
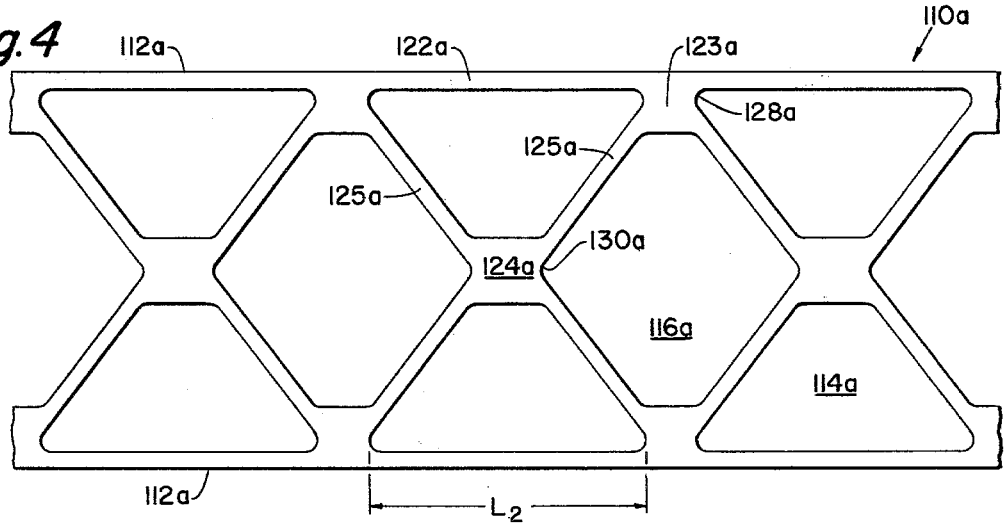
FIG. 4 is a top plan view of a segment of a carrier device created by the preform of FIG. 3.

Turning now to FIGS. 3 and 4, a second embodiment of the invention is shown wherein a preform strip **10*a* again includes a first and second series of slots 14*a* and 16*a* arranged in much the same fashion as those in the embodiment just described. However, the width of each of the slots 14*a* and 16*a* is slightly greater and the base of the first slot 14*a* is enlarged to form a T-shaped section 26*a* which is joined to the remaining stem-like portions of the slot with a narrow radius ear section 28*a*. Likewise, a narrow small radius enlargement 30*a* of the second slot 16*a* is created essentially at the center line of the strip. In operation, this preform 10*a* is stretched in a fashion identical to that described above resulting in a carrier device 110*a*. However, the enlarged width enables a flattened section at the apex of the "V" to be formed between the resulting V-shaped bands 25*a* while the radius sections 28*a* and 30*a* enable a sharper apex 130*a* in the finger hole region 116*a* and at the intersection of bands 122*a* and 125*a* and 138*a* in aperture 114*a*. It should be noted that the relative dimensions W1 and W2 remain in the preform 10*a* in order to produce the carrier device 110*a***.

Figure 5:
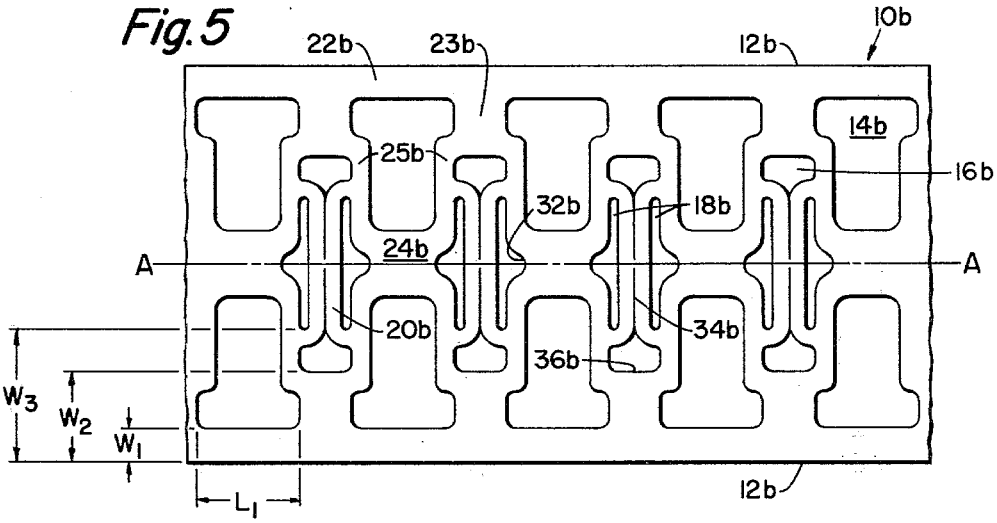
FIG. 5 is a top plan view of a segment of a further embodiment of a preform strip incorporating the invention.

Again in keeping with the invention, a further embodiment of a preform is shown in FIG. 5. However, in this embodiment a preform **10*b* is provided for producing a somewhat different carrier device 110*b* shown in FIG. 6. As in the above-noted embodiment, the preform strip 10*b* is defined by laterally extending edges 112*b* and includes a first series of laterally spaced slots 14*b* which have extremities spaced from the side edges a first laterial distance W1 represented by the distance of the segment 22*b* which is a first length L1. A second slot means 16*b* which is alternatingly positioned between the first slot 14*b* and the extremities of 16*b* are spaced a second lateral distance W2 from the edge 22*b* in keeping with the concept disclosed above. However, in the example shown in FIG. 5, slot means 16***b* includes an enlarged end portion 36*b* and a frangibly interconnected region 34*b* which, upon application of the proper longitudinal stretching force, expands longitudinally to create the finger receiving apertues 116*b* in carrier 110*b*. It should also be noted that the third series of narrow slots 18*b* are incorporated in the strip 10*b*. A pair of such narrow slots 18*b* are arranged on either side of each of the second slot means 16*b*. These narrow third slots are of again limited width and length extending transverse of the strip and extending through the longitudinal center line A—A. However, the length of the third slots 18*b* is less than the total length of the first and second slots 16*b* and is defined by a third lateral distance W3. The segment 20*b* of the strip between the third slots and the associated second slot means becomes a laterally extending strap 124*b* upon stretching of this strip in accordance with the invention in creating carrier device 110*b*.

Figure 6:
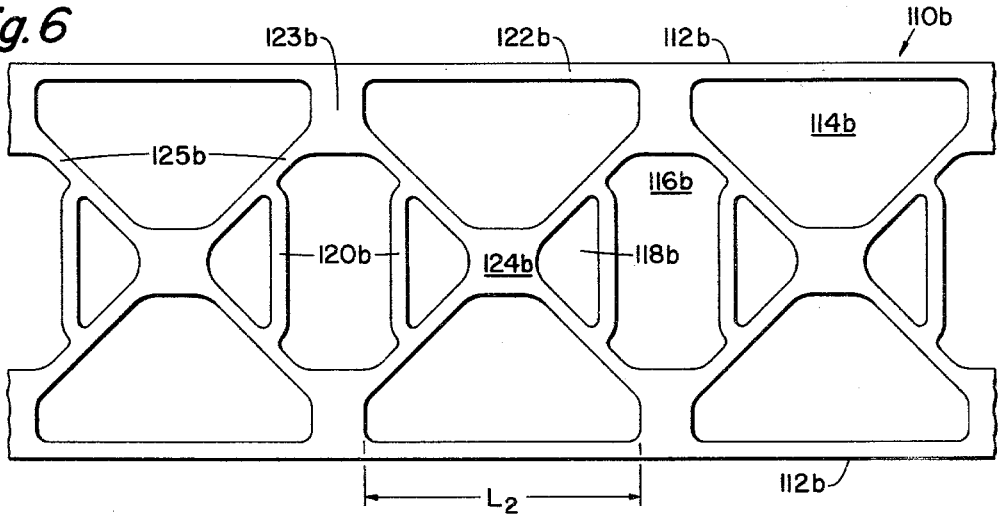
FIG. 6 is a top plan view of a carrier device strip created by the preform of FIG. 5.

With reference to FIGS. 5 and 6, it will be apparent that preform 10*b* and carrier device 110*b* will be shown to be similar im most respects to the preforms 10 and 10*a* and carrier devices 110 and 110*a* in that device 110 and 10 includes a narrow, strengthened elongated outer band segment 122*b* and a slightly elongated and stretched V-shaped inner band section 125*b*. However, it also includes a set of bands 120*b* extending intermediate laterally adjacent bands 125*b* with the third slot 18*b* creating a triangular aperture 118*b*. These resulting strips 120*b* serve as finger engaging straps aiding in the carrying of the package as well as serving as aperture reconfiguring straps in accordance with the teachings of the above-noted carriers which are reconfigured upon lateral stretching forces.

Thus, in keeping with the invention, a dynamic carrier device is created by a longitudinally stretched preform.

It should be understood that while a carrier device is shown including a pair of laterally arranged container receiving appertures, more than two laterally arranged apertures can be created by using the general teachings of this invention and it is not intended that the invention be directed and limited to strips of carrier retaining bands which are only of the two lane variety.

It should also be noted that the carrier produced by the preform is unique in that it has a highly oriented and very strong outer band section and prestretched but yet dynamic V-shaped inner band sections.

Thus, it is apparent that there has been provided in accordance with the invention a container carrier preform strip and resulting carrier device that fully satisfies the objects aimed and advantages set forth above.

The invention has been described in conjunction with specific embodiments thereof and it is evident that many alternatives, modifications and variations will be apparent to those skilled in the art in light of the foregoing description. Accordingly, it is intended to embrace all such alterantives, modifications and variations that fall within the spirit and broad scope of the appending claims.

I claim:

1. A container carrier preform strip adapted to be stretchingly, permanently deformed in the longitudinal direction of the strip to create a package making device for a plurality of substantially identical containers, the preform strip including a plurality of narrow, elongated slot means extending generally perpendicular to the longitudinal axis of the strip all of which are completely confined within the lateral side edges of the strip, the plurality of slot means comprising alternating spaced series of slot means, a first series including a pair of laterally aligned slots extending on both sides of the longitudinal axis and spaced therefrom with the laterally outermost extremities of each of the pair of slots spaced from the associated lateral edge, a first strip segment thereby formed on each lateral margin of the strip, each of said segments defined by predetermined first lateral and longitudinal dimensions, said first lateral dimension extending from the lateral outermost extremities of each of the pair of slots to the associated lateral edge of the strip, said first longitudinal dimensions determined by the width of the slot in the longitudinal direction of the strip at the lateral outermost extremities of the slots, a second series including narrow elongated slot means, adapted to traverse the longitudinal axis, the laterally outermost extremities of each of the narrow elongated slot means in said second series being spaced from the associated lateral edge of the strip by a second strip segment having a second predetermined lateral dimension, which is greater than the first predetermined lateral dimension, wherein said preform strip is thereby configured to be stretched in the longitudinal direction to transform the first series of slot means into laterally aligned generally triangular container receiving and holding apertures.

2. The preform strip of claim 1 wherein opposing side marginal edges of each narrow elongated slot means of the second series are frangibly interconnected to permit formation of longitudinally spaced apertures between series' of container receiving and holding apertures when a longitudinal stretching force is applied to said preform strip.

3. The preform strip of claim 1 including a third series of slot means, each of said third series of slot means positioned between an associated slot means from the first and second series, the laterally outermost extremities of said third series being spaced from the associated later edge of the strip a third predetermined lateral dimension which is greater than said second predetermined lateral dimension, whereby finger gripping straps are created within the apertures formed between the container receiving and holding apertures upon application of the longitudinal stretching force.

4. The preform strip of claim 1 wherein the slot means of each of the first and second series are slots of substantially uniform width between their longitudinal extremities.

5. The preform strips of claim 1 wherein each of the pair of slots in the first series are substantially T-shaped with the laterally outermost extremities of each of the pair incorporating enlarged width regions relative to the remaining portions of the narrow slot.

6. The preform strip of claim 5 wherein each of the second series of narrow slot means includes a region of increased width substantially at the longitudinal axis of the strip, the increased width region formed by small radius extensions of both opposing side margins of the elongated slot.

7. The preform of claim 3, wherein each of the slot means in the third series includes a region of increased width located generally along the longitudinal axis of the strip, the increased width portion formed by small radius extensions of the side margin of the elongated slot which is adjacent the associated pair of slots in the first series.

8. A thermo-plastic carrier device adapted to be reconfigured by application of laterally stretching forces during application to associated generally cylindrical can members including a plurality of series of laterally aligned, non-circular can receiving apertures formed by narrow integrally interconnected band segments, each laterally outermost band segments of each rank of apertures being substantially oriented and strengthened in the direction of the longitudinal axis of the device, a pair of inner band segments forming at least part of the laterally outermost can receiving apertures, said inner band segments being V-shaped and extending from an apex inwardly of the lateral margins of the carrier device so each of the pairs of inner band segments extend diagonally outwardly toward an associated outermost band segment, each of said inner band segments being prestretched an amount less than an amount to create complete molecular orientation.

* * * * *